US012291936B2

(12) United States Patent
Peta et al.

(10) Patent No.: US 12,291,936 B2
(45) Date of Patent: May 6, 2025

(54) DRILL AHEAD ROTATING CONTROL DEVICE METHODOLOGY AND SYSTEM

(71) Applicant: Schlumberger Technology Corporation, Sugar Land, TX (US)

(72) Inventors: Madhu Sudhana Rao Peta, Andhra Pradesh (IN); Nathaniel Pettibone, Houston, TX (US); David Clark, Houston, TX (US); Niall Robert Ferguson, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/153,098

(22) Filed: Jan. 11, 2023

(65) Prior Publication Data

US 2024/0229593 A1 Jul. 11, 2024

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | |
|---|---|---|---|
| 9,650,852 | B2 | 5/2017 | Arnt |
| 10,167,694 | B2 | 1/2019 | Le |
| 10,364,625 | B2 | 7/2019 | Grace |
| 10,370,923 | B2 | 8/2019 | Le |
| 10,408,000 | B2 | 9/2019 | Wagoner |
| 10,605,021 | B2 | 3/2020 | Le |
| 10,648,262 | B2 | 5/2020 | Tran |
| 10,876,368 | B2 | 12/2020 | Le |
| 10,995,562 | B2 | 5/2021 | Wagoner |
| 11,149,507 | B2 | 10/2021 | Tran |
| 11,326,403 | B2 | 5/2022 | Wagoner |
| 2012/0000664 | A1* | 1/2012 | Nas ..... E21B 33/0387 166/344 |
| 2012/0085545 | A1 | 4/2012 | Tarique |
| 2012/0318496 | A1 | 12/2012 | Bailey |

(Continued)

FOREIGN PATENT DOCUMENTS

| | | |
|---|---|---|
| OA | 18268 | 9/2018 |
| WO | 2019168981 A1 | 9/2019 |

*Primary Examiner* — Tara Schimpf
*Assistant Examiner* — Lamia Quaim
(74) *Attorney, Agent, or Firm* — Kelly McKinney; Jeffrey D. Frantz

(57) ABSTRACT

A technique facilitates deployment and use of a seal rotating system without retrieving the running tool prior to a drilling operation. The running tool remains with the drill string after deployment of the seal rotating system which saves substantial time by avoiding retrieval of the running tool prior to conducting the drilling operation. According to an embodiment, a seal rotating system is mounted to the running tool and the running tool is connected into a drill string. The running tool is used to position the seal rotating system in a rotating control device housing which may be positioned along, for example, a riser. The running tool is then released from the seal rotating system and is moved downhole as part of the drill string to enable performance of a borehole drilling operation without removing the running tool.

13 Claims, 5 Drawing Sheets

(56) References Cited

U.S. PATENT DOCUMENTS

| | | | | |
|---|---|---|---|---|
| 2013/0175044 | A1 | 7/2013 | Telfer | |
| 2021/0131205 | A1 | 5/2021 | Tran | |
| 2022/0205335 | A1* | 6/2022 | Martins | E21B 21/08 |
| 2022/0364421 | A1* | 11/2022 | Nguyen | E21B 17/0465 |

* cited by examiner

DRILL AHEAD ROTATING CONTROL DEVICE METHODOLOGY AND SYSTEM

BACKGROUND

In many oil and gas well applications, a rotating control device is used to contain and isolate pressure in the wellbore annulus while rotary drilling. The rotating control device comprises a housing and an inner seal rotating system. When used in offshore operations, e.g. subsea drilling, the rotating control device housing may be integral to a riser system extending up through the sea toward a surface facility from a seabed location. The seal rotating system is deployed inside the rotating control device housing and at least portions of the system rotate with the drill string during a drilling operation while maintaining a seal between the drill string and the rotating control device housing. A running tool is used to carry the seal rotating system down through, for example, the riser, until deployed into the rotating control device housing. However, the running tool is then pulled back to the surface and removed before the drill string can be run back in hole so that drilling can begin.

SUMMARY

In general, a methodology and system facilitate deployment and use of a seal rotating system without retrieving the running tool prior to a drilling operation. The running tool remains with the drill string after deployment of the seal rotating system, thus saving substantial time by avoiding retrieval of the running tool prior to conducting the drilling operation. According to an embodiment, a seal rotating system is mounted to the running tool and the running tool is connected into a drill string. The running tool is used to position the seal rotating system in a rotating control device housing which may be positioned along, for example, a riser. The running tool is then released from the seal rotating system and is moved downhole as part of the drill string to enable performance of a borehole drilling operation without removing the running tool.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which generally facilitate the drilling of a borehole, e.g. a wellbore. In forming various hydrocarbon, e.g. oil and/or gas, wells a rotating control device is used to contain and isolate pressure in the wellbore annulus while rotary drilling. The rotating control device comprises a housing and an inner seal rotating system. In this example, the methodology and system described below facilitate deployment and use of the seal rotating system without retrieving the running tool prior to a drilling operation. The running tool remains with the drill string after deployment of the seal rotating system. This approach saves substantial time by avoiding retrieval of the running tool prior to conducting the drilling operation.

When used in deepwater operations, for example, a traditional running tool may take up to 24 hours to deploy. In some deepwater applications, the methodology described below may reduce that time by a factor of four or more. The rig operation time savings translates directly to cost savings.

According to an embodiment, a seal rotating system is mounted to a running tool and the running tool is connected into a drill string. The running tool is used to position the seal rotating system in a rotating control device housing. In deepwater applications, the rotating control device housing may be positioned along a riser. The running tool is then released from the seal rotating system and is moved downhole as part of the drill string to enable performance of a borehole drilling operation without removing the running tool.

Figure 1:
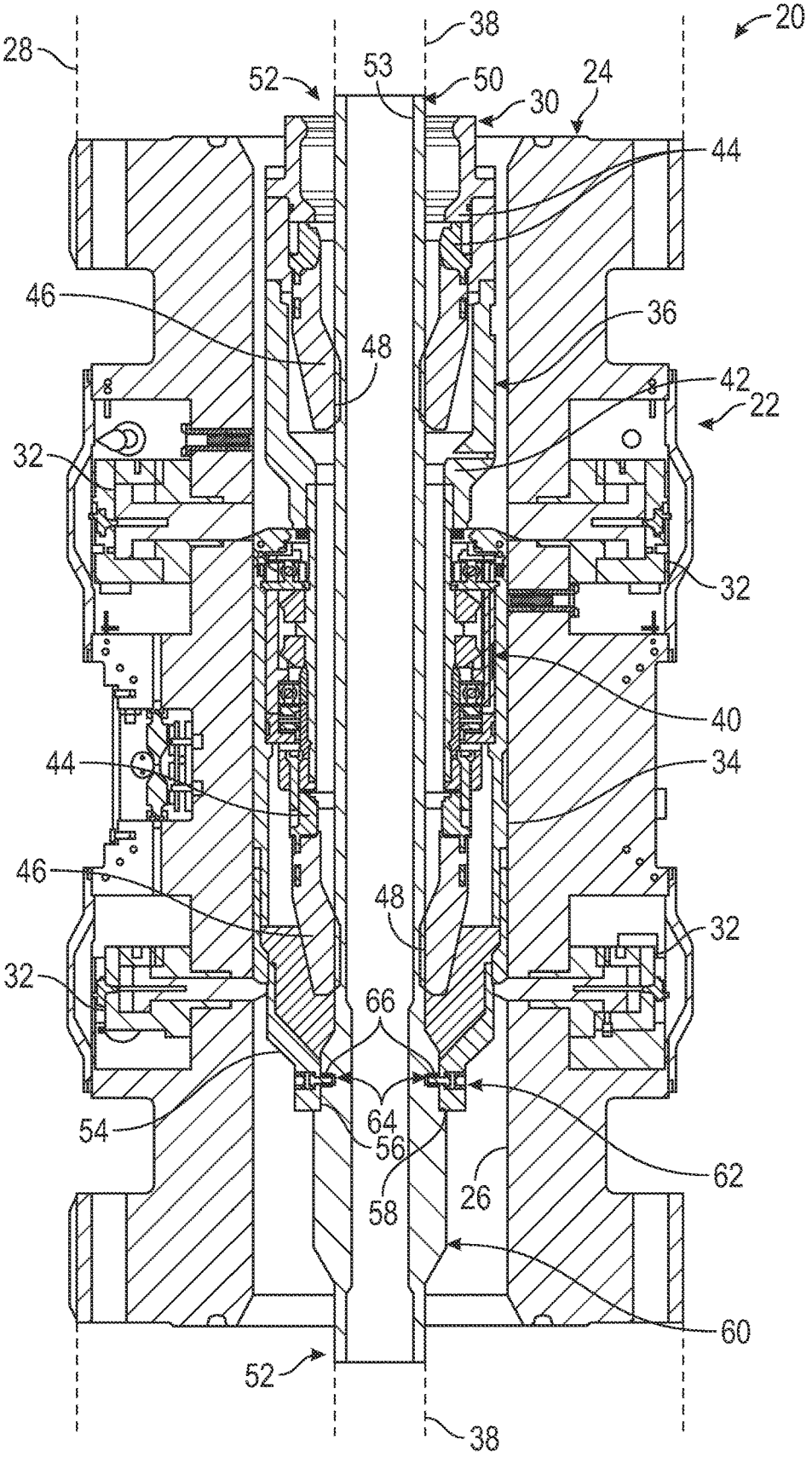
FIG. 1 is an illustration of an example of a system for containing and isolating pressure in a borehole annulus while rotary drilling, according to an embodiment of the disclosure.

Referring generally to FIG. 1, a system 20 for containing and isolating pressure in a borehole annulus, e.g. a wellbore annulus, while rotary drilling is illustrated. In this example, the system 20 comprises a rotating control device 22 having a rotating control device housing 24 forming an internal longitudinal passage 26. In a variety of subsea applications or other deepwater applications, the rotating control device housing 24 may be positioned along a riser 28 extending between, for example, a seabed location and a surface facility. However, the rotating control device housing 24 may be positioned along other types of equipment for use in other types of drilling applications.

In the illustrated example, the rotating control device 22 also comprises a seal rotating system 30. The seal rotating system 30 is constructed for movement down into the rotating control device housing 24 via passage 26 where it is held in a desired position along passage 26 via fastening mechanisms 32. In some embodiments, the fastening mechanisms 32 may be remotely controllable from a surface location. For example, the fastening mechanisms 32 may be hydraulically or electrically controlled and may comprise pistons, threaded members, or other suitable mechanisms which may be moved into passage 26 so as to secure the seal rotating system 30 at the desired location along passage 26.

Figure 2:
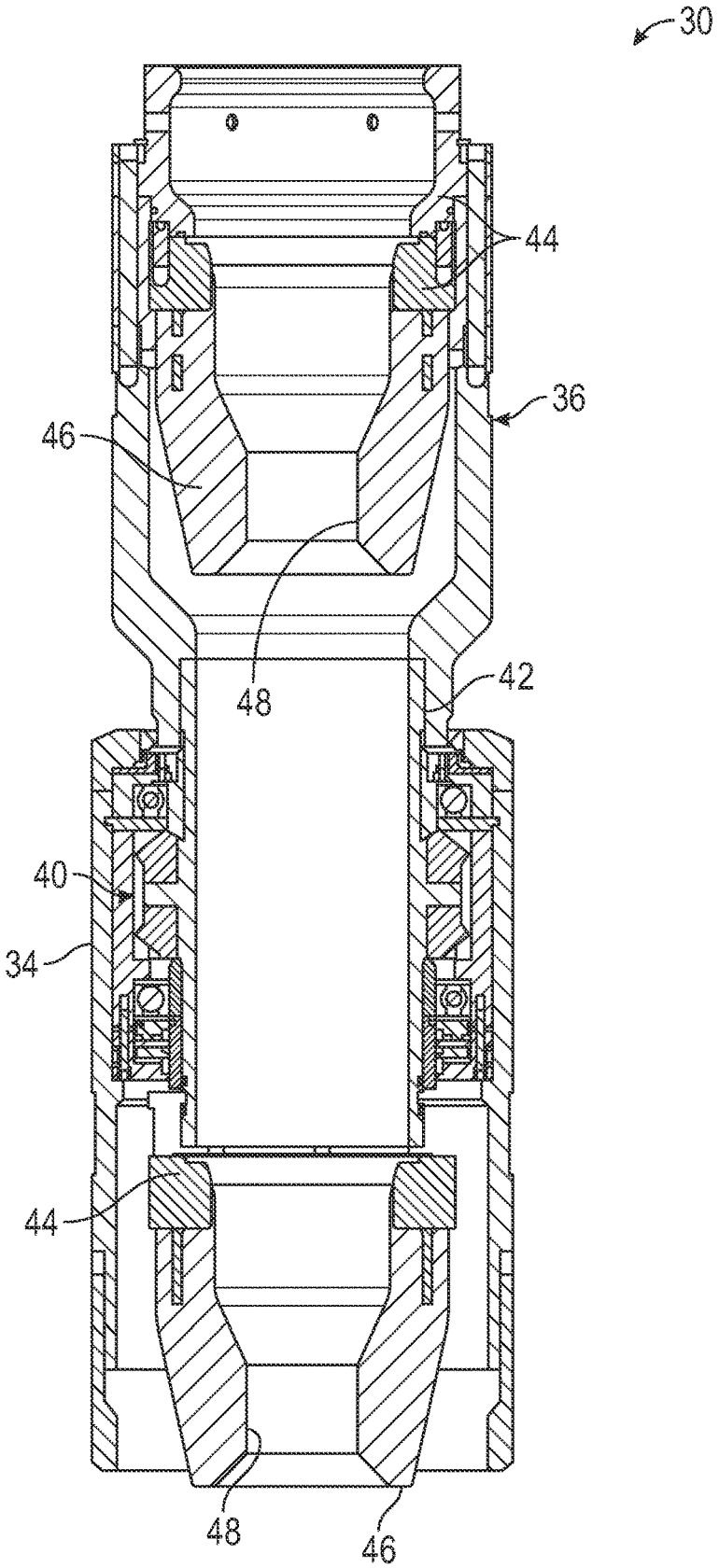
FIG. 2 is a cross-sectional view of an example of a seal rotating system, according to an embodiment of the disclosure.

With additional reference to FIG. 2, the seal rotating system 30 may comprise a stationary housing structure 34 which is secured with respect to the rotating control device housing 24 via fastening mechanisms 32. The seal rotating system 30 also comprises a dynamic or rotating portion 36 which is allowed to rotate with a drill string 38 via a bearing assembly 40. The bearing assembly 40 is mounted between the stationary housing structure 34 and a dynamic housing structure 42 of dynamic portion 36. The dynamic housing structure 42 is able to freely rotate with respect to the stationary structure 34 via bearing assembly 40.

The dynamic housing structure 42 may be constructed in a variety of configurations with a variety of features and components. For example, the dynamic housing structure 42 may comprise suitable types of couplers 44 by which at least one seal 46, e.g. an elastomeric seal, is connected to the dynamic housing structure 42. In the embodiment illustrated, a plurality of seals 46, e.g. two elastomeric seals 46, may be used and positioned, for example, above and below bearing assembly 40. Each of the seals 46 is constructed with an opening 48 sized to receive the drill string 38 therethrough while remaining in sealing engagement with the drill string 38. The bearing assembly 40 allows the seals 46 and the dynamic housing structure 42 to rotate with the drill string 38.

Figure 3:
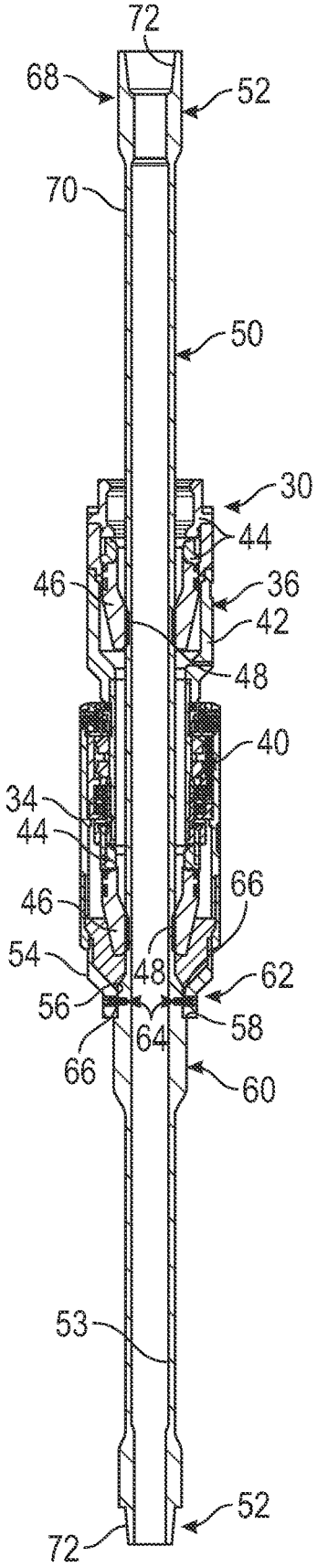
FIG. 3 is a cross-sectional view of an example of the seal rotating system illustrated in FIG. 2 positioned on a running tool, according to an embodiment of the disclosure.

Referring also to FIG. 3, the seal rotating system 30 may be deployed and lowered into the rotating control device housing 24 via a running tool 50. For example, once the bearing assembly 40 of the seal rotating system 30 is in the rotating control device housing 24, a pull test may be performed to confirm the position of the seal rotating system 30 within the rotating control device housing 24. The running tool 50 comprises connection ends 52 which allow the running tool 50 to be coupled into drill string 38 and to become a part of drill string 38. For example, the connection ends 52 may be in the form of box and pin connection ends such as those used to connect joints of drill pipe when assembling various types of drill strings 38.

As the drill string 38 is made up on a rig, for example, the seal rotating system 30 may be mounted on the running tool 50 by sliding the running tool 50 through the interior of the seal rotating system 30. Additionally, the seal rotating system 30 is releasably secured to the running tool 50. The running tool 50 may then be connected into the drill string 38. Subsequently, additional joints of drill string 38 may be connected above the running tool 50 as the running tool 50 and attached seal rotating system 30 are moved downwardly. It should be noted the illustrated running tool 50 has an internal passageway 53 through which fluid may be flowed. For example, drilling mud may be flowed down through the drill string 38 and thus through passageway 53. The mud flow returns may be routed through, for example, a side outlet located below the rotating control device housing 24.

In the embodiment illustrated, the stationary housing structure 34 comprises a mounting portion 54 having an opening 56 sized to slide along the running tool 50 until the mounting portion 54 comes to rest on a shoulder 58 formed along an expanded portion 60 of running tool 50. Once the seal rotating system 30 is resting on shoulder 58, a releasable mounting system 62 is used to temporarily affix the seal rotating system 30 on shoulder 58 of running tool 50. This allows the running tool 50 to be used for securely deploying the seal rotating system 30 down, e.g. down through riser 28, until the seal rotating system 30 is moved into passage 26 and secured via fastening mechanisms 32.

At this stage, the releasable mounting system 62 enables release of running tool 50 from seal rotating system 30 so that the running tool 50 may be moved downhole as part of drill string 38 to perform a desired drilling operation, e.g. a wellbore drilling operation. By way of example, the releasable mounting system 62 may comprise a shear member 64, e.g. a plurality of shear members 64. In the embodiment illustrated, the plurality of shear members 64 take the form of shear bolts 66 positioned to temporarily secure mounting portion 54 of seal rotating system 30 to running tool 50. Various other types of releasable mounting systems 62 may be used to enable controlled release of the running tool 50 from seal rotating system 30 so as to enable the desired drilling operation without retrieving the running tool 50 to the surface.

When the desired drilling operation is completed or otherwise interrupted, the drill string 38 may be pulled to the surface. As the running tool 50 is moved upwardly with the drill string 38, the shoulder 58 once again engages the seal rotating system 30 (via mounting portion 54) as it moves into the rotating control device housing 24. The fastening mechanisms 32 are then released to allow the seal rotating system 30 to be lifted from the rotating control device housing 24. In this manner, the seal rotating system 30 is automatically lifted to the surface with the running tool 50 as the drill string 38 is retrieved.

Figure 4:
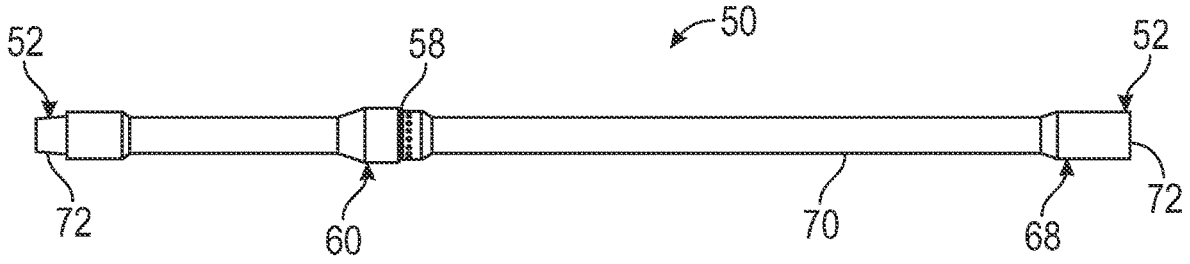
FIG. 4 is a side view of an example of a running tool, according to an embodiment of the disclosure.
Figure 5:
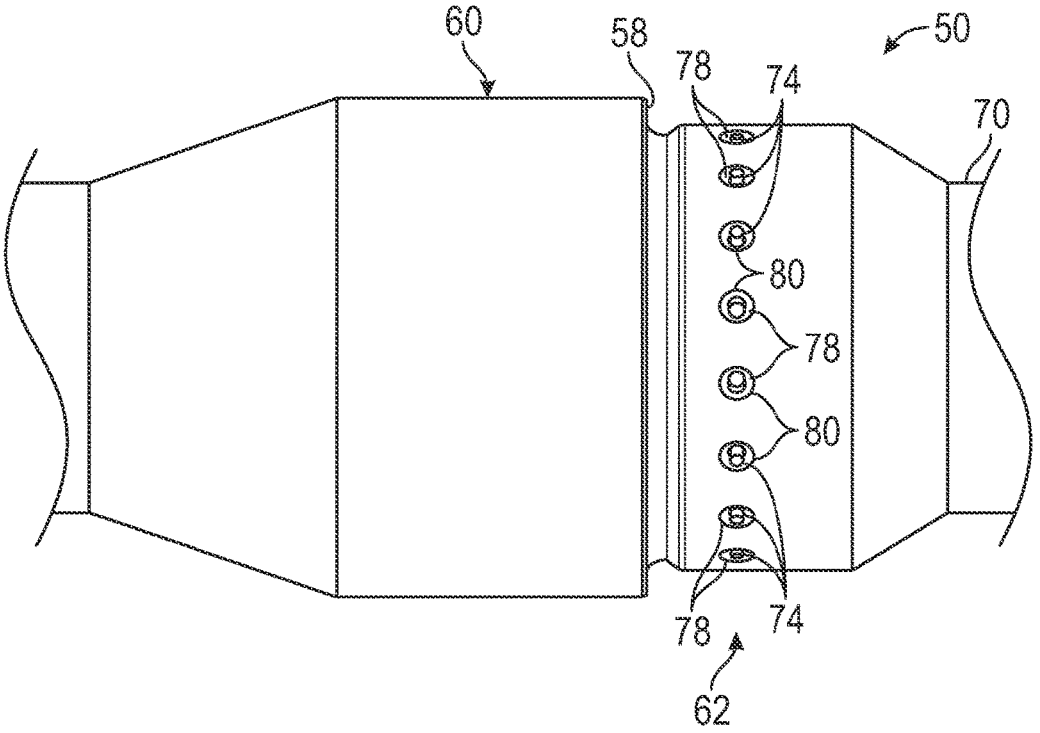
FIG. 5 is a side view of a portion of the running tool comprising a releasable mounting system by which the seal rotating system may be releasably mounted to the running tool, according to an embodiment of the disclosure.

Referring generally to FIGS. 4 and 5, an embodiment of running tool 50 is illustrated. In this example, running tool 50 is formed as an elongate body 68 having a mandrel 70 extending between connection ends 52. By way of example, the connection ends 52 may be in the form of pin and box connection ends having threaded regions 72 positioned for threaded engagement with the consecutive pipe joints of drill string 38.

The expanded portion 60 is a larger diameter section located along the mandrel 70. According to one or more embodiments of the present disclosure, the larger diameter section of the expanded portion 60 may be set up like a stabilizer with carbide bricks and fluting to allow passing of cuttings and reduce wear on the diameter of the section. As illustrated, the expanded portion 60 defines shoulder 58 which is oriented to catch and block further downward travel of seal rotating system 30 as described above.

Figure 7:
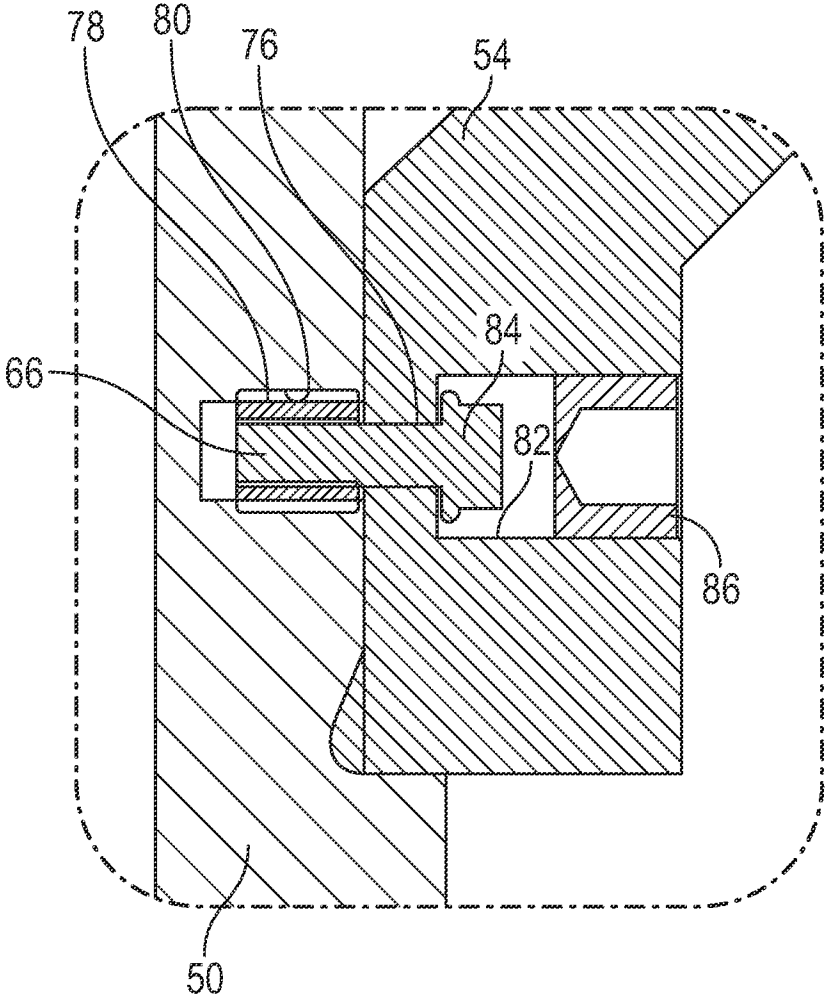
FIG. 7 is an expanded cross-sectional view of a shear member used in the releasable mounting system illustrated in FIG. 6, according to an embodiment of the disclosure.
Figure 6:
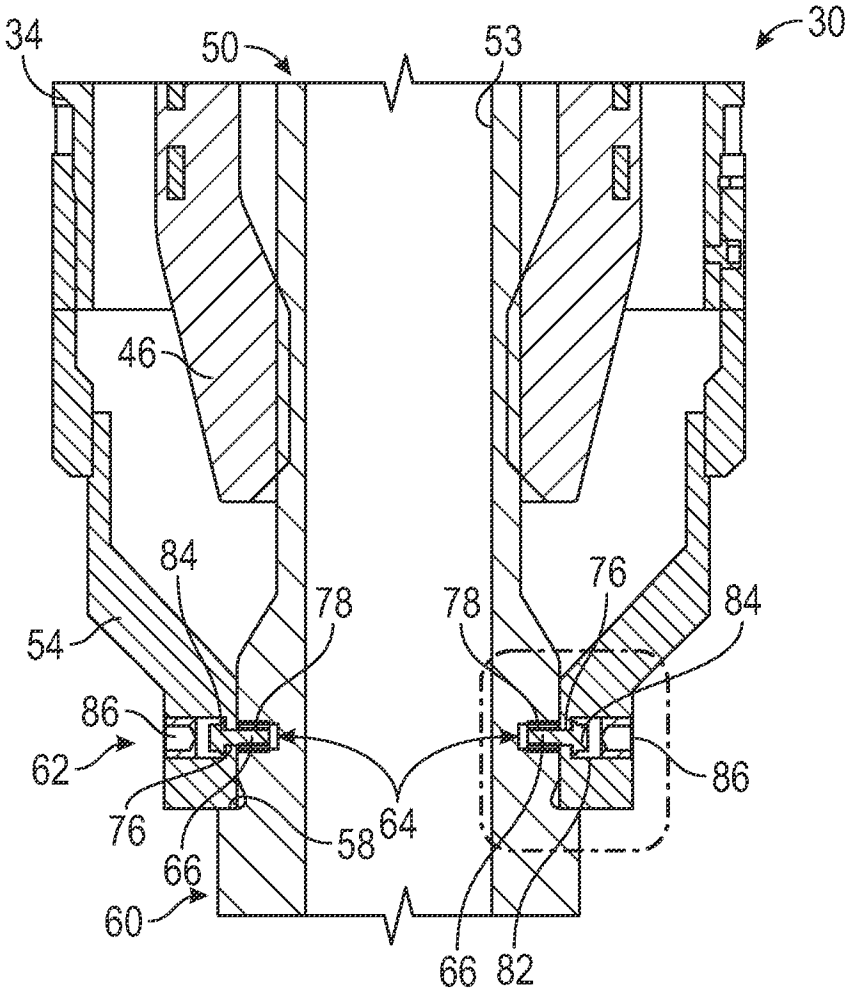
FIG. 6 is a cross-sectional view of one example of the releasable mounting system, according to an embodiment of the disclosure.

When releasable mounting system 62 comprises shear bolts 66, the elongate body 68 may be formed with threaded openings 74 oriented laterally to threadably receive corresponding threaded shear bolts 66. By way of example, the threaded openings 74 may be positioned circumferentially about the expanded portion 60 on an uphole side of shoulder 58. The threaded shear bolts 66 may be inserted through lateral openings 76 of mounting portion 54 (see FIGS. 6 and 7) and threaded into openings 74 so as to temporarily secure the seal rotating system 30 on running tool 50.

In this example, the number of threaded openings 74 is greater than the number of shear bolts 66/lateral openings 76 to facilitate rotational alignment of the seal rotating system 30 when securing it to running tool 50. By way of example, the number of threaded openings 74 may be three times greater than the number of shear bolts 66 (e.g. 18 threaded openings 74 and six shear bolts 66). This allows the seal rotating system 30 to be secured to the running tool 50 at a variety of different rotational angles. In some embodiments, the threaded openings 74 may be formed in bushings 78 which are releasably coupled with elongate body 68.

By way of example, the bushings 78 may have external threads and may be threadably engaged with corresponding threaded openings 80 formed in elongate body 68. In this manner, the running tool 50 is protected from damage when the shear bolts 66 are sheared to release the seal rotating system 30 as the running tool 50 is moved downhole with the drill string 38 to perform the desired drilling operation, e.g. wellbore drilling operation. If the shearing action damages the internal threads of bushings 78, the bushings 78 may simply be removed from elongate body 68 and replaced with new bushings 78. The use of bushings 78 also enables easy changing of the diameter of threaded openings 74 by simply swapping in different bushings 78. This allows the use of different size shear bolts 66 so as to change the shear force needed to release the running tool 50 from the seal rotating system 30.

Referring again to FIGS. 6 and 7, an embodiment of releasable mounting system 62 is illustrated in which shear bolts 66 are threadably engaged with bushings 78. Bushings 78 may be releasably secured in elongate body 68 at, for example, expanded portion 60. In this embodiment, the lateral openings 76 extend from a recessed portion 82 formed in mounting portion 54.

As illustrated, each of the shear bolts 66 may have a bolt head 84 which is retained in the recessed portion 82 after shearing of the shear bolts 66. Furthermore, each of the bolt heads 84 may be retained by a cap 86, e.g. a threaded cap, secured in or at the recessed portion 82 so as to trap the bolt head 84 and prevent it from falling downhole after shearing. The other end of each shear bolt 66 is retained via its threaded engagement with the corresponding bushing 78.

The system utilizing shear bolts 66 provides an example of releasable mounting system 62 which enables secure attachment of the seal rotating system 30 to the running tool 50 until the seal rotating system 30 is properly secured in rotating control device housing 24. Then, sufficient weight/force may be applied to the drill string 38 so as to shear the shear bolts 66, thus releasing the running tool 50 from the seal rotating system 30. The running tool 50 may then be moved downhole with the drill string 38 to facilitate performance of the desired drilling operation.

According to a deepwater operational example, the running tool 50 is stabbed into the bottom of the seal rotating system 30 at the surface rig and then lifted until the shoulder 58 rests against the bottom of the seal rotating system 30 (against mounting portion 54). Then, multiple shear bolts 66 are threaded into openings 74 in selected, corresponding bushings 78 so as to secure the seal rotating system 30 to the running tool 50. The running tool 50 and the seal rotating system 30 may then be lifted and torqued into the drill string 38 followed by deployment of the running tool 50 and seal rotating system 30 down the riser 28 and into the rotating control device housing 24.

When the seal rotating system 30 is properly inside the rotating control device housing 24, it is landed and latched in place via fastening mechanisms 32. At this point, the weight of the drill string 38 may be used to shear the shear bolts 66 and to release the running tool 50 from the seal rotating system 30 so the running tool 50 and the drill string 38 may be moved down through the interior of seal rotating system 30. Thus, the drill string 38, including running tool 50, is free to continue ahead for performance of the desired drilling operation.

After the drilling operation is completed or otherwise stopped, the drill string 38 may be retrieved to the surface along with the running tool 50. The shoulder 58 of running tool 50 engages with the seal rotating system 30 as the running tool 50 is pulled upwardly through the rotating control device housing 24. The seal rotating system 30 is unlatched from the rotating control device housing 24 by releasing fastening mechanisms 32 and then lifted back to the surface via shoulder 58 as the drill string 38 is pulled to the surface.

Depending on the specific well operation and well equipment, the overall system 20 may be adjusted and various additional or alternate components may be utilized. For example, the features, size, and shape of the seal rotating system 30 and running tool 50 may be adjusted. Additionally, the components may be constructed for use in a variety of subsea applications and also other types of drilling applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for drilling a wellbore, comprising:
- positioning a rotating control device housing along a riser;
- mounting a seal rotating system to a running tool;
- connecting the running tool into a drill string;
- lowering the seal rotating system into the rotating control device housing via the running tool;
- releasing the seal rotating system from the running tool; and
- moving the running tool down through the seal rotating system with the drill string for a wellbore drilling operation,
- wherein the mounting comprises: resting the seal rotating system on a shoulder of the running tool; and securing the seal rotating system to the running tool with shear bolts, and
- wherein securing the seal rotating system to the running tool comprises threadably engaging the shear bolts with removable bushings of the running tool,
- the method further comprising providing a greater number of the removable bushings than the shear bolts to facilitate securing the seal rotating system to the running tool at a variety of different rotation angles.

2. The method as recited in claim 1, further comprising pulling the drill string to the surface following the wellbore drilling operation.

3. The method as recited in claim 2, wherein pulling the drill string comprises lifting the seal rotating system to the surface via the running tool.

4. The method as recited in claim 1, further comprising providing the seal rotating system with an elastomeric seal which seals about the drill string and is rotatable with the drill string during the wellbore drilling operation.

5. The method as recited in claim 1, further comprising providing the seal rotating system with a plurality of elastomeric seals which seal about the drill string and are rotatable with the drill string during the wellbore drilling operation.

6. The method as recited in claim 4, further comprising using a bearing assembly to facilitate rotation of the elastomeric seal with the drill string.

7. A method, comprising:
- mounting a seal rotating system to a running tool;
- connecting the running tool into a drill string;

using the running tool to position the seal rotating system in a rotating control device housing; and maintaining the running tool as part of the drill string as the drill string is moved down through the seal rotating system to perform a borehole drilling operation, wherein mounting comprises: resting the seal rotating system on a shoulder of the running tool; and securing the seal rotating system to the running tool with shear bolts, and wherein securing the seal rotating system to the running tool comprises threadably engaging the shear bolts with removable bushings of the running tool, the method further comprising providing a greater number of the removable bushings than the shear bolts to facilitate securing the seal rotating system to the running tool at a variety of different rotational angles.

8. The method as recited in claim 7, further comprising pulling the drill string to the surface following the borehole drilling operation.

9. The method as recited in claim 8, wherein pulling the drill string comprises lifting the seal rotating system to the surface via the running tool.

10. The method as recited in claim 7, further comprising providing the seal rotating system with an elastomeric seal which seals about the drill string and is rotatable with the drill string during the borehole drilling operation.

11. The method as recited in claim 7, further comprising providing the seal rotating system with a plurality of elastomeric seals which seal about the drill string and are rotatable with the drill string during the borehole drilling operation.

12. The method as recited in claim 10, further comprising using a bearing assembly to facilitate rotation of the elastomeric seal with the drill string.

13. A system, comprising:

a seal rotating system for containing and isolating pressure during a wellbore drilling operation; and a running tool, the running tool being connectable into a drill string, the running tool further comprising a releasable mounting system to which the seal rotating system is releasably mounted in a manner which enables deployment of the seal rotating system and performance of a subsequent drilling operation via the drill string without retrieving the running tool, wherein the releasable mounting system comprises a shoulder on which the seal rotating system rests, wherein the releasable mounting system further comprises a shear member which secures the seal rotating system on the shoulder, wherein the shear member comprises a plurality of shear bolts, wherein the shear bolts of the plurality of shear bolts are threadably engaged with bushings which are removably mounted in a body of the running tool, and wherein the system comprises a greater number of the bushings than the shear bolts to facilitate securing the seal rotating system to the running tool at a variety of different rotation angles.

* * * * *